United States Patent [19]

Stevens

[11] 4,000,583

[45] Jan. 4, 1977

[54] BELT-TYPE ABRADER WITH MEANS TO COMPENSATE FOR TOOL WEAR

[75] Inventor: Arthur Royden Stevens, Torquay, England

[73] Assignee: Centrax Limited, England

[22] Filed: Jan. 9, 1975

[21] Appl. No.: 539,846

[30] Foreign Application Priority Data

Jan. 15, 1974 United Kingdom ..... 1830/74

[52] U.S. Cl. ..... 51/135 R; 51/145 R; 51/165.87

[51] Int. Cl.[2] ..... B24B 21/18; B24B 49/00

[58] Field of Search ..... 51/165 R, 165.87, 165.88, 51/135 R, 145, 101 R

[56] References Cited

UNITED STATES PATENTS

| | | | |
|---|---|---|---|
| 3,533,191 | 10/1970 | Mason | 51/165.87 X |
| 3,727,350 | 4/1973 | Schaller | 51/165.88 X |
| 3,782,046 | 1/1974 | Schaap | 51/165.87 X |
| 3,791,084 | 2/1974 | Kakumu | 51/165.87 |

*Primary Examiner*—Al Lawrence Smith
*Assistant Examiner*—Nicholas P. Godici
*Attorney, Agent, or Firm*—Oblon, Fisher, Spivak, McClelland & Maier

[57] ABSTRACT

A blade polishing machine using an abrasive belt and including an arrangement for compensating for wear on the belt. The machine employs a master cam and a cam follower to control the finished shape of the blade; after each blade has been polished, the cam follower is shifted slightly to bring the belt guiding pulley closer to the next blade, thus compensating for the reduced thickness of the belt. The mechanism for shifting the cam follower includes a wedge which moves stepwise under the control of an escapement; the wedge can be replaced by a wedge of different taper to suit the average amount of wear on the belt involved in the particular job in hand.

14 Claims, 8 Drawing Figures

BELT-TYPE ABRADER WITH MEANS TO COMPENSATE FOR TOOL WEAR

BACKGROUND OF THE INVENTION

1. Field of the Invention

This invention relates to machine tools, and particularly but not exclusively to abrasive belt machines for polishing blades for rotodynamic compressors and turbines.

2. Description of the Prior Art

Machines for finishing turbine blades and the like by polishing with an abrasive belt have already been disclosed, for example, in U.S. Pat. No. 2,606,406 to P.M. Mueller. Mueller's patent discloses a machine which embodies a copying prinicple to ensure that the blade is polished to the correct shape; however, unless manual adjustments were to be made, the blades produced by this machine would become steadily larger as the belt became thinner through wear.

Copying grinding machines which avoid this disadvantage have been proposed in, for example, U.S. Pat. No. 2,641,089 to Fouquet. However, all such machines employ grinding wheels rather than abrasive belts, and avoid the need for manual adjustments only at the expense of dressing the grinding wheel at frequent intervals, for example after polishing a single blade. This is an uneconomical solution, and is in any case unsuited to a machine using an abrasive belt.

SUMMARY OF THE INVENTION

It is therefore an object of the invention to provide a machine tool for producing workpieces of predetermined shape, which removes material from the workpieces by mechanical means, and which can maintain the size of the finished workpieces within close tolerances without manual adjustments, despite the inevitable wear on the material-removing means.

Thus the invention provides a machine tool comprising a base, a first mounting supported by the base for carrying a workpiece, a second mounting supported by the base, means supported by the second mounting for mechanically removing material from the surface of the workpiece, means for moving at least one of the first and second mountings relative to the base to produce movement of the material-removing means along a predetermined path relative to the workpiece, whereby the workpiece is brought to a predetermined configuration, compensating means having a body portion and an output member, said output member being arranged for progressive compensating movement at a predetermined rate relative to the body portion, and transmission means for transmitting the compensating movement to one of the workpiece and the material-removing means to produce a relative movement of the material-removing means towards the surface of the workpiece, whereby wear of the material- removing means is at least partially offset. The compensating movement will normally be selected to offset the average rate of wear of the material removing means, so that only random variations will occur in the size of the finished workpieces and there will be no steady change in size as the material-removing means wears.

The compensating movement may, for example, occur in a series of increments, each increment following the preceding increment after a predetermined number of workpieces have been finished.

The invention also provides a copying machine tool comprising: a base; a first mounting supported by the base for carrying a workpiece and a master cam; a second mounting supported by the base; a cam follower mounted on the second mounting; and means supported by the second mounting for mechanically removing material from the surface of the workpiece; at least one of the first and second mountings being movable relative to the base; first means for moving the movable mounting or mountings to move the material-removing means towards the surface of the workpiece, the movement being limited by engagement of the cam follower with the master cam, whereby the position of the material-removing means relative to the workpiece is determined by the configuration of the master cam; and second means for moving one of the workpiece, the master cam, the cam follower and the material-removing means relative to its mounting to produce a predetermined progressive compensating movement of the material-removing means towards the workpiece, whereby wear of the material-removing means is at least partially offset.

In the preferred construction, the second moving means is operatively connected between the second mounting and the cam follower to move the cam follower relative to the second mounting away from the master cam. Specifically, the second moving means comprises adjustable stop means for limiting movement of the cam follower relative to the second mounting in a direction generally normal to the surface of the master cam, and an actuator for moving the cam follower relative to the second mounting in said generally normal direction and alternatively in the opposite direction, whereby the stop means can be adjusted to provide the compensating movement at a time when the position of the cam follower is not controlled by the stop means. It also comprises means for clamping the cam follower against movement relative to the second mounting. This prevents the loads on the cam follower which occur during operation from being transferred to the stop means.

The stop means in the preferred construction includes a wedge mounted on the the second mounting for movement in a direction longitudinal of the wedge and normal to the direction of movement of the cam follower, and means for controlling such movement of the wedge. The amount of the progressive compensating movement can therefore be altered by fitting a wedge having a different taper.

BRIEF DESCRIPTION OF THE DRAWINGS

Other features and objects of the invention will become apparent from a study of the following description of a blade polishing machine, together with the accompanying drawings, of which.

DETAILED DESCRIPTION OF THE PREFERRED EMBODIMENTS

Figure 1:
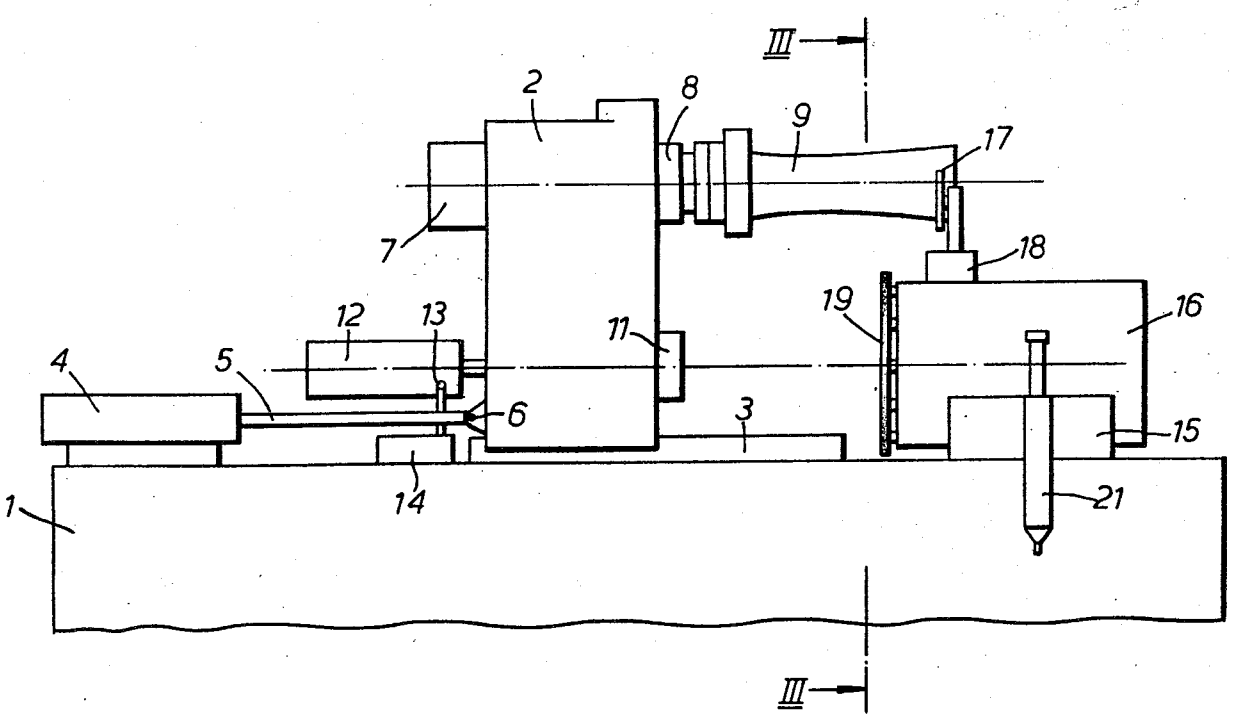
FIG. 1 is a much simplified side elevation of the machine.

As seen in FIG. 1, the polishing maching comprises a bed 1 on which is mounted a travelling headstock 2 which can be reciprocated on longitudinal guides 3 by an actuator comprising a hydraulic cylinder 4 which is fixed to the bed 1 and a piston rod 5 connected at 6 to the headstock 2. The headstock carries a hydraulic motor 7 which drives a first face plate 8 carrying a cam 9 by clamps which enable the position of the cam 9 on the face plate 8 to be adjusted and a second face plate 11 which carries the blade to be polished. The headstock includes gearing by which the motor 7 drives the two face plates 8 and 11 at the same speed and in the same direction. The spindle, on one end of which the face plate 11 is mounted, carries at its opposite end a three-dimensional speed cam 12 which controls the position of a follower 13. The follower 13 controls a valve 14 which adjusts the flow of hydraulic fluid to the motor 7 so that the cam 12 controls the instantaneous rate of rotation of the face plates 8 and 11.

Fixed to the bed 1 is a mounting block 15 on which is pivoted a belt drive assembly 16 which carries a stylus wheel 17 by mounting means 18 which will later be described in greater detail. The assembly 16 also includes a number of pulleys on which is mounted an endless abrasive belt 19. The drive assembly 16 can be moved as an arm about its pivot axis 20 on the block 15 by a pneumatic piston-and-cylinder assembly 21 so as to move the stylus wheel 17 into contact with the cam 9 and to move the abrasive belt into contact with a blade carried in the face plate 11.

Figure 3:
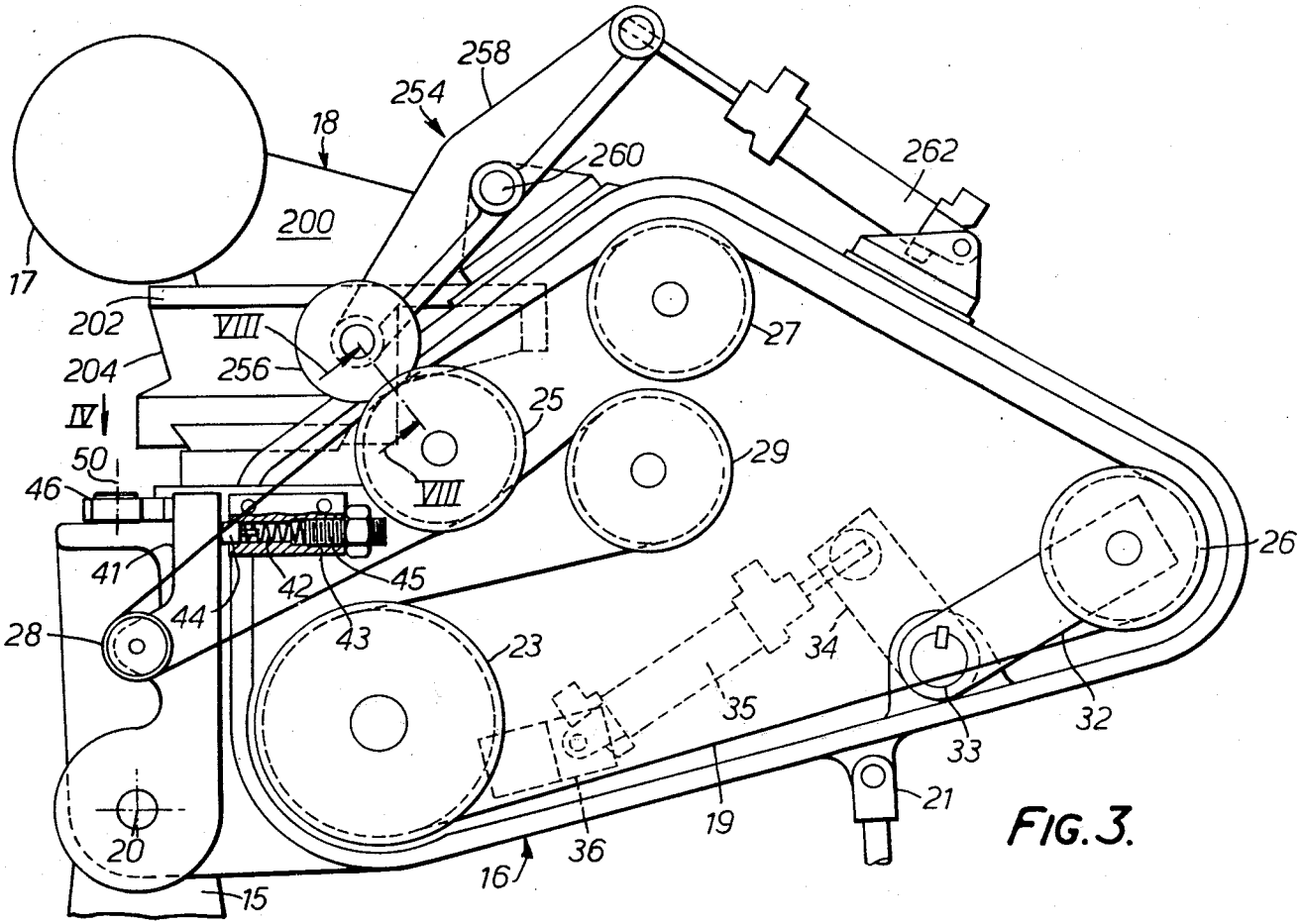
FIG. 3 is an end elevation of the belt drive assembly on the line III-III in FIG. 1.
Figure 4:
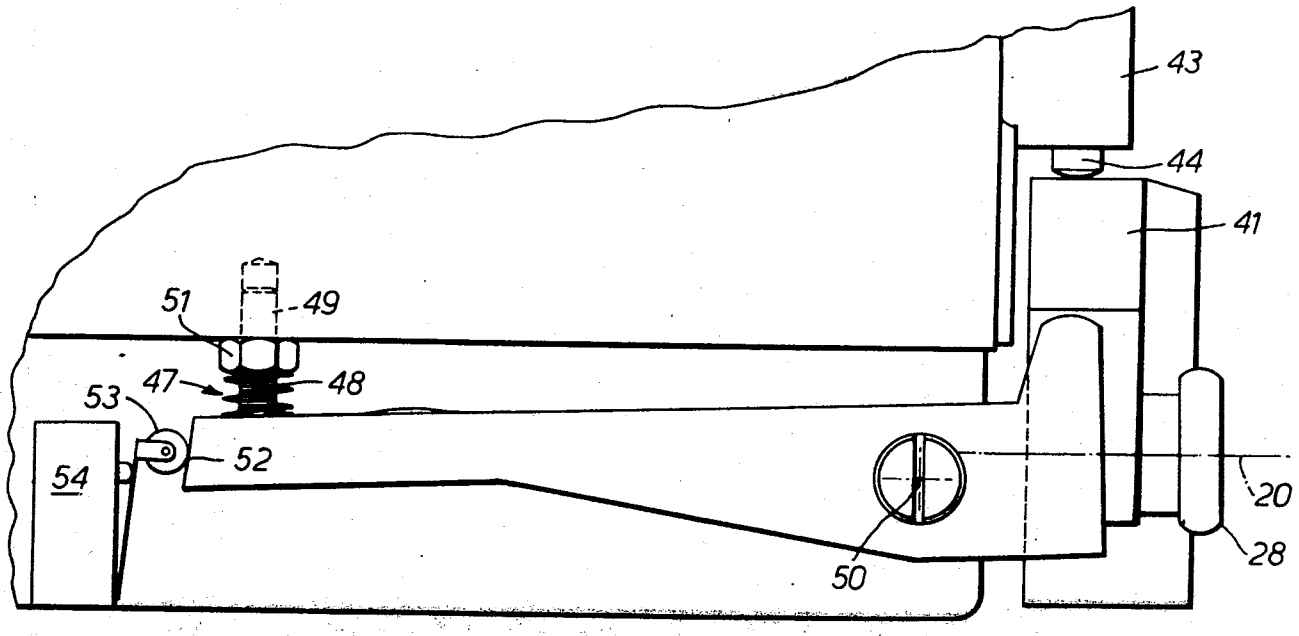
FIG. 4 is a plan view of the arm carrying the contact wheel seen in the direction of the arrow IV in FIG. 3.

As can be seen in FIG. 3, the abrasive belt 19, which is an endless bias-woven flexible belt having abrasive particles secured to it by adhesive, passes around a drive pulley 23 which is driven by an electric motor via an input shaft coincident with the pivot axis. The belt also passes around idler pulleys 25, 26, 27, the contact wheel 28 and a further idler pulley 29. The pulleys are all crowned, and all except the contact wheel 28 are fitted with guiding cheeks. The idler pulley 26 is mounted on an arm 32 which is mounted on a rotatable shaft 33. Tension in the belt is maintained by pressure in a piston-and-cylinder assembly 35 extending between an arm 34 fixed to the shaft 33 and a fixed point 36 on the belt drive assembly 16. A micro-switch (not shown) is provided to detect a broken belt. The arm 32 moves rapidly in a clockwise direction, as seen in FIG. 3, on the occurrence of a broken belt, and in so doing closes the micro-switch. A pneumatic valve can be used in place of the micro-switch. As can be seen in FIG. 3, the contact wheel is mounted on a contact wheel arm 41 which is pivotable about the pivot axis 20 of the belt drive assembly 16. The contact wheel arm 41 is biased in an counter-clockwise direction, as seen in FIG. 3, i.e., towards the blade to be polished, by a spring 42 which is contained in a block 43 mounted on the belt drive assembly 16, and has a sliding plunger 44 at one end to engage the contact wheel arm 41 and an adjustable screw 45 at the other end by which the pressure applied by the spring to the arm can be adjusted. As can be seen in FIG. 4, the upper end of the contact wheel arm 41 abuts against one end of a finger 46 which extends in a direction parallel with the pivot axis 20 and is pivoted about an approximately vertical axis 50. The finger 46 can engage at its other end with an adjustable stop 47 formed by a screw 48 in a tapped hole 49 in the belt drive assembly 16, the position of the screw 48 being locked by a nut 51. The outer end face of the finger 46 is formed with a cam surface 52 which engages a follower 53 on a micro-switch 54. A fluidic sensor can be used in place of the micro-switch 54.

Operation of the apparatus so far described is as follows. During polishing, the cam 9 and the blade carried in the face plate 11 are rotated about their axes, their speed at any instant being determined by the three-dimensional speed cam 12, and the headstock is continuously reciprocated by the hydraulic cylinder 4. When polishing is to commence, the piston-and-cylinder assembly 21 pivots the belt drive assembly 16 at a controlled speed in a direction, which is counter-clockwise in FIG. 3, until the stylus wheel 17 engages the cam 9 whereupon full pessure is supplied to the assembly 21. Shortly before this engagement occurs, and assuming that the blade is slightly oversize, the belt passing around the contact wheel 28 will engage the blade. The spring 42 will yield so that the rotational movement of the contact wheel about the pivot axis 20 will slightly lag on the belt drive assembly 16 and the pressure with which the belt is applied to the blade will depend upon the amount by which the spring 42 is compressed and the tension on the belt. The headstock will continue to be reciprocated and metal will continue to be removed from the blade progressively until finger 46 engages the stop 47. At this stage the axes of the stylus wheel 17, the contact wheel 28 and the pivot axis 20 will be in line and accordingly the blade will be brought to the size determined by the shape of the cam. At this time the micro-switch 54 will be actuated by the cam 52 and this, in conjunction with a preset time delay set to the blade length, will cause the machine to cease operation at the end of the next return stroke of the piston and cylinder 4, 5 whereupon the piston-and-cylinder assembly 21 will retract to return the belt drive assembly 16 to its initial position.

Figure 5:
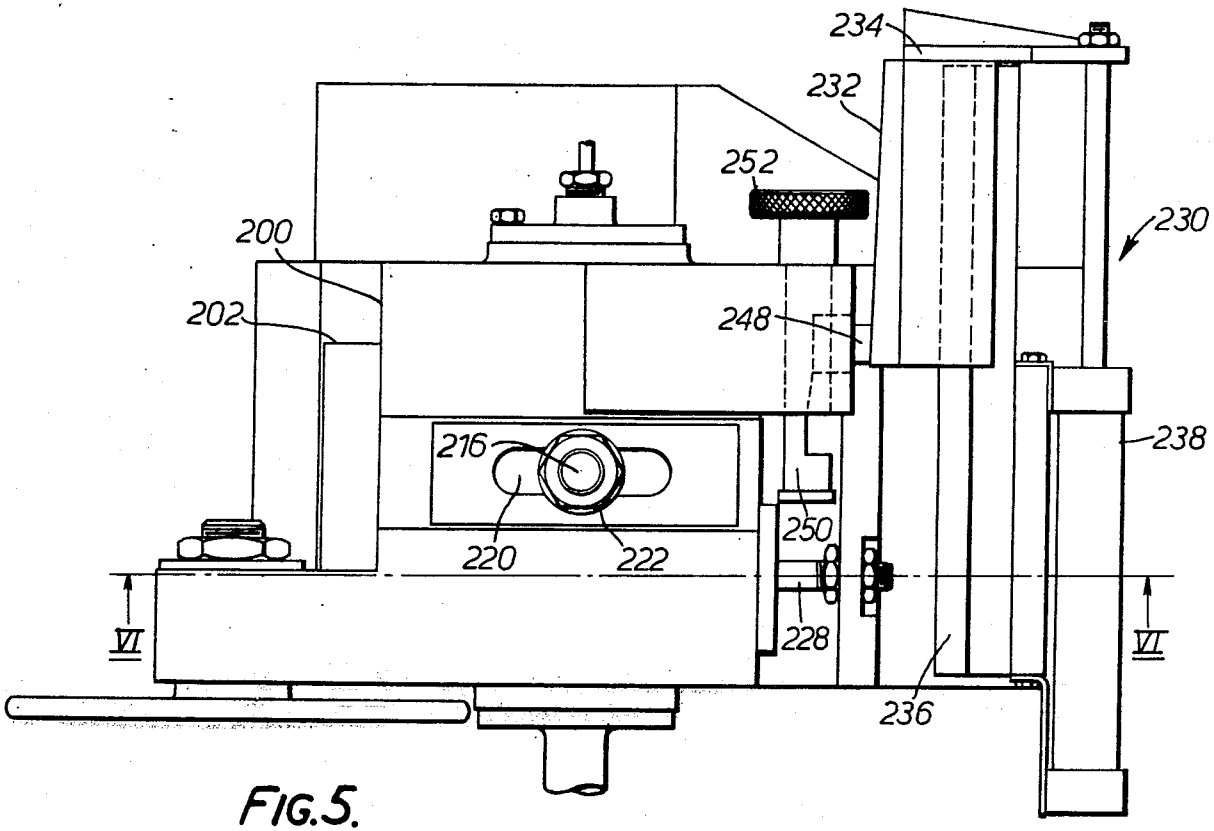
FIG. 5 is a detailed plan view of the mounting for the stylus wheel.
Figure 6:
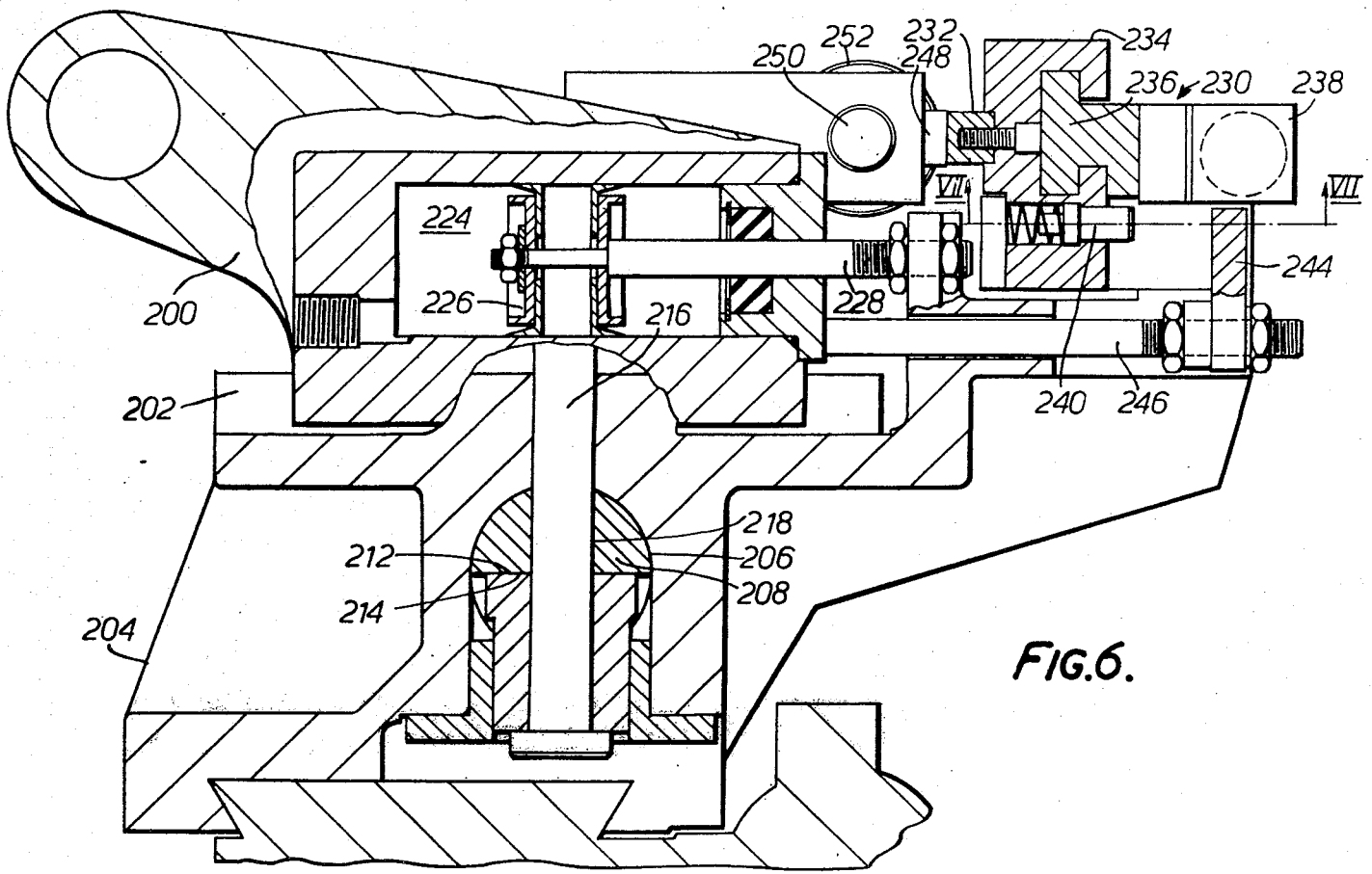
FIG. 6 is a detailed end elevation, sectioned on the line VI—VI of FIG. 5, of the mounting for the stylus wheel.

The mounting means 18 by which the stylus wheel 17 is mounted on the belt drive assembly 16 is shown in greater detail in FIGS. 5 and 6 and includes a slide assembly 200 which is mounted on slides 202 on a casting 204 secured to the assembly 16. The slides 202 are generally horizontal and allow the slide assembly 200, which carries the stylus wheel 17, to move towards and away from the cam 9. By adjustment of the position of the slide assembly 200 relative to the assembly 16, the finished size of the blades produced by the machine can be adjusted; in particular, the size of the blades can be kept constant despite wear of the abrasive belt 19.

Figure 2:
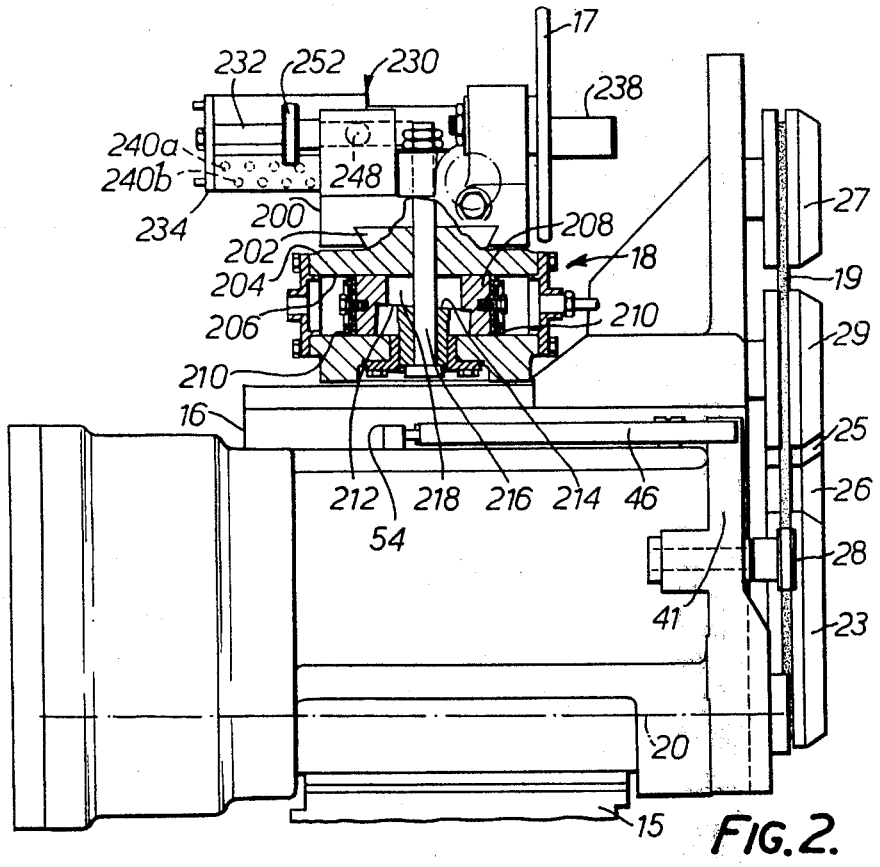
FIG. 2 is a side elevation partly in section of the belt drive assembly seen from the opposite side from FIG. 1.
Figure 7:
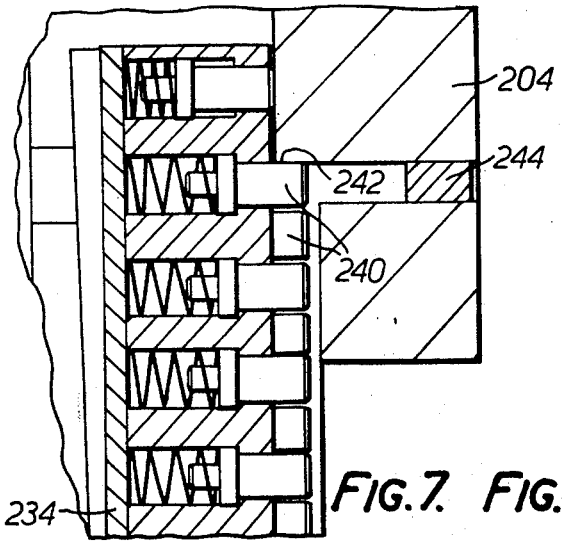
FIG. 7 is a scrap sectional plan view of the indexing mechanism, taken on the line VII-VII of FIG. 6.

The slide assembly 200 can be clamped to the casting 204 to prevent movement while a blade is being polished. The clamping mechanism, which can be seen most clearly in FIG. 2, includes a pneumatic cylinder 206 which is formed in the casting 204. A piston assembly 208 is slidable within the cylinder, and carries a seal 210 at each end. The central portion of the piston assembly 208, between the seals 210, has an inclined wedge surface 212 which co-operates with a correspondingly inclined surface 214 on a clamp bolt assembly 216. The clamp bolt assembly 216 is mounted for vertical sliding in the casting 204, and passes through a slot 218 in the piston assembly 208; the slot is aligned longitudinally of the piston assembly 208, so that its sliding is not obstructed by the clamp bolt assembly. The upper end of the clamp bolt assembly 216 passes through a slot 220 in the slide assembly 200, and carries lock nuts 222. Thus when compressed air is admitted to the right-hand end of the cylinder 206 (as seen in FIG. 2), the piston assembly 208 is urged to the left, the clamp bolt assembly 216 is tensioned, and the tensile force is transmitted by the lock nuts 222 to the slide assembly 200, clamping the slide assembly to the casting 204. By admitting compressed air to the left-hand end of the cylinder 206, the tension in the clamp bolt assembly is released, and the slide assembly 200 can be moved on the slides 202. The slot 220 is parallel to the slides 202 to allow such movement.

To move the slide assembly 200 on the casting 204, a pneumatic cylinder 224 containing a piston 226 is incorporated in the slide assembly. The piston rod 228 projects at the right-hand end of the cylinder (as seen in FIG. 5), and is connected to the casting 204. Thus, by admitting air to the left-hand end of the cylinder 224, the slide assembly can be moved to the left.

The sequence of operation of the parts of the mounting means 18 so far described in as follows. At the end of a cycle, when a blade has been completely polished, the piston-and-cylinder assembly 21 retracts to return the belt drive assembly 16 to its initial position. The piston assembly 208 is then shifted to the right to unclamp the slide 200, and compressed air is admitted to the left-hand end of the cylinder 224 to shift the slide assembly to the left. This action also indexes a compensating mechanism 230 which will be described later. The slide assembly 200 is then shifted to the right by the admission of compressed air to the right-hand end of the cylinder 224 through an inlet (not shown). The limit of the rightward movement of the slide assembly is set by the compensating mechanism 230, which is so arranged that after each indexing, the slide assembly can move slightly further to the right. The slide assembly is then clamped by moving the piston assembly 208 to the left, and the machine is ready to begin a new cycle as soon as an unpolished blade has been mounted on the face plate 11.

The change in the position of the slide assembly 200 resulting from one indexing of the compensating mechanism 230 is so chosen that, after each indexing, the contact wheel 28 can move closer to the blade being polished by an amount equal to the average wear on the belt 19 resulting from the polishing of one blade. The size of the blades after polishing will therefore remain substantially constant despite the wear on the belt.

The compensating mechanism 230 includes a wedge 232 which is mounted on a wedge carrier 234. The wedge carrier 234 is mounted on slides 236 fixed to the casting 204 so that the wedge and wedge carrier can slide in a direction parallel to the pivot axis 20 of the belt drive assembly 16. The wedge carrier 234 is biased to the right (as seen in FIG. 2) by a pneumatic piston-and-cylinder assembly 238, of which the cylinder is mounted on the casting 204 and the piston rod is connected to the wedge carrier. Compressed air is supplied to the assembly 238 to maintain the biasing force as long as the same abrasive belt 19 is in use.

The wedge carrier 234 also carries a number of indexing pins 240 which are arranged in two parallel staggered horizontal rows **240*a* and 240*b*, and are spring-loaded to project from the surface of the wedge carrier 234. An abutment 242 is provided on the casting 204, in such a position that it can engage the side surface of any of the pins 240 in either of the rows, to prevent movement of the wedge carrier 234 under the biasing force of the assembly 238. However, at the end of a polishing cycle, a trigger 244, which is connected by a rod 246 with the slide assembly 200, moves to the left (as seen in FIG. 6) with the slide assembly and presses the pin which is at that time engaged with the abutment 242 into the wedge carrier 234, against its spring-loading. The wedge carrier 234 then moves about one-sixteenth of an inch under the biasing force from the assembly 238, since its movement is no longer obstructed by the pin which has just been pressed in. After this movement, one of the pins in the other row of pins engages the side of the trigger 244 and the wedge carrier stops. When the slide assembly 200 and the trigger 244 move to the right again, the pin which has been pressed in cannot spring out again, as it has moved about one-sixteenth of an inch past the abutment 242. Accordingly, as soon as the trigger 244 is clear of the pin which has engaged its side surface, the wedge carrier 234 can move about one-quarter of an inch further under the bias of the assembly 238 until the next pin (which has just been engaging the trigger 244) engages the abutment 242**.

Thus, at the end of each polishing cycle, the wedge 232 is moved about five-sixteenths of an inch, in such a direction that its thin end moves towards the position previously occupied by its thick end.

The abutment 242, with which the indexing pins 240 engage, extends sufficiently far in the direction of movement of the wedge carrier 234 to keep all those pins which have been pressed into the wedge carrier pushed in throughout the remainder of the travel of the wedge carrier. Thus, when the belt 19 is worn out and a new one is to be fitted, the wedge carrier 234 can be returned to its initial position by means of the piston-and-cylinder assembly without obstruction by the pins 240, which simply spring out again as they pass the edge of the abutment 242.

The slide assembly 200 carries, at its end opposite the stylus wheel 17, an abutment 248 which engages the wedge to limit the rightward movement of the slide assembly. The abutment 248 will contact a thinner part of the wedge 232 during each successive cycle, thus allowing the slide assembly to move slightly further to the right during each cycle, as mentioned above.

The abutment 248 is in fact adjustable relative to the slide assembly 200, depending on whether coarse or fine polishing is being carried out. The abutment 248 is slidably mounted on the slide assembly, and transmits forces to the slide assembly, through a two-position spacer 250. The spacer 250 has two portions of slightly different thickness, a selected one of which can be placed between the abutment 248 and the body of the slide assembly 200 by moving a knob 252 to an appropriate position. The thicker portion of the spacer is used for coarse polishing, causing the contact wheel 28 to remain relatively further from the blade axis, while the thinner portion is used for fine polishing. The machine also includes a belt crushing mechanism 254 which co-operates with the idler pulley 25 to soften an initially flat newly-fitted belt 19 so that it is able to adopt a curved profile as it passes over the crowned contact wheel. This crushing is done before any blades are polished using the new belt, as the edges of the belt would otherwise abrade the blade to too great a depth, especially where twisted blades are involved.

The crushing mechanism 254 includes a polyurethane tyred wheel 256 whose circumference is waisted, so that it is complementary to the crowning of the idler pulley 25. The wheel 256 is rotatably mounted on one end of a lever 258 whose mid-point is pivoted to the belt drive assembly 16, as shown at 260, and whose other end is connected to the belt drive assembly 16 by a pneumatic piston-and-cylinder device 262. When the crushing mechanism is to be used, the drive pulley 23 is driven, not by the normal electric motor, which is arranged to produce a belt speed of several thousand feet per minute, but by an auxiliary friction drive which acts on a timing belt which forms part of the normal drive mechanism. The auxiliary friction drive is arranged to drive the belt at a very low speed, for example, the whole length of the belt may pass around the various pulleys in two minutes.

Figure 8:
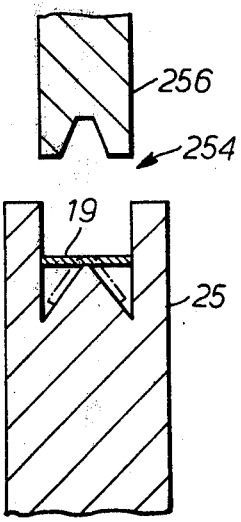
FIG. 8 is a scrap section of the belt crushing mechanism, taken on the line VIII—VIII of FIG. 3.

Compressed air is supplied to the device 262 to extend it and therefore to rotate the lever 258 counterclockwise (as seen in FIG. 3). The wheel 256 enters between the cheeks of the idler pulley 25 and the belt 19 is crushed between the idler pulley 25 and the wheel 256, as shown in dotted lines in FIG. 8. After a short period, for example 2 minutes, of running in this condition, the belt will have been softened sufficiently to follow the crowning of the contact wheel 28, and blade polishing can resume. The softening is due mainly to the partial breaking up of the structure of the belt.

The wedge 232 is secured to the wedge carrier 234 by screws, so that it can be replaced by a wedge of different taper, to suit the job in hand.

I claim:

1. In a copying machine tool comprising a base, a first mounting supported by said base for carrying a workpiece and a master cam, a second mounting supported by said base, a cam follower mounted on said second mounting, a plurality of pulleys, a flexible abrasive belt supported by said pulleys, one of said pulleys being mounted on said second mounting in a position to press said belt against said workpiece to remove material from the surface thereof, a motor for driving another of said pulleys, at least one of said first and second mountings being movable relative to said base, and means for moving said movable mounting or mountings to move said one of said pulleys towards said surface of said workpiece, said movement being limited by engagement of said cam follower with said master cam, whereby the position of said abrasive belt relative to said workpiece is determined by the configuration of said master cam, so that said workpiece is brought to a predetermined configuration, the improvement comprising:

compensating means having a body portion and an output member, said output member being arranged for progressive compensating movement at a predetermined rate relative to said body portion; and transmission means for transmitting said compensating movement to one of said workpiece and said one of said pulleys to produce a relative movement of said abrasive belt toward said surface of said workpiece, whereby wear of said abrasive belt is at least partially offset.

2. A machine tool according to claim 1 which further comprises sensing means for producing a control signal when said workpiece has been brought to said predetermined configuration, and control means coupled to said sensing means for receiving said control signal and for terminating operation of said machine tool on receipt of said control signal, said compensating means including means for producing incremental compensating movements of said output member relative to said body portion, with each incremental movement following the preceding incremental movement after a predetermined number of control signals from said sensing means.

3. A machine tool according to claim 2 in which said means for producing incremental compensating movements of said output member is arranged to produce one of said incremental movements in response to each control signal from said sensing means.

4. A machine tool according to claim 1 in which said compensating means comprises a wedge supported on said body portion for longitudinal movement, an abutment which is supported for contact with the tapered surface of said wedge for movement generally normal to said tapered surface is response to longitudinal movement of said wedge, and is connected to said output member of said compensating means, and means for moving said wedge longitudinally to produce said compensating movement of said output member.

5. A machine tool according to claim 4 in which said means for moving said wedge longitudinally comprises wedge biasing means biasing said wedge for longitudinal movement in one direction, and indexing means for conrolling movement of said wedge in said one direction.

6. A machine tool according to claim 5 in which said indexing means comprises a pin carrier which is mounted for movement with said wedge, a plurality of pins which are axially movably mounted in said pin carrier with their axes transverse to the direction of movement of said wedge, pin biasing means for biasing said pins to positions in which said pins project from said pin carrier, an abutment positioned to engage the side surface of one of said pins at a time to resist movement of said wedge in response to the biasing force exerted by said wedge biasing means, and a trigger supported for movement relative to said abutment in a direction transverse to said direction of movement of said wedge to press said one pin into said pin carrier against the biasing force exerted by said pin biasing means, whereby said wedge will move under the influence of said wedge biasing means until further movement is resisted by another of said pins.

7. A machine tool according to claim 6 in which said pins are arranged in said pin carrier in a plurality of rows each extending parallel to said direction of movement of said wedge.

8. A machine tool according to claim 1 wherein said transmission means includes a transmission member movable relative to said body portion of said compensating means, clamping means for preventing movement of said transmission member relative to said body portion, and actuator means for producing movement of said transmission member away from and towards said output member.

9. A machine tool according to claim 8 which further includes adjusting means for causing compensating movement of said output member when said actuator means is operated to move said transmission member away from said output member.

10. A copying machine tool according to claim 1 in which said first mounting includes means for synchronously rotating said workpiece and said master cam about parallel axes.

11. A copying machine tool according to claim 10 in which said first mounting is movable on said base in a direction parallel to said parallel axes.

12. A copying machine tool according to claim 11 in which said second mounting is mounted on said base for pivoting about an axis parallel to said parallel axes.

13. A copying machine tool according to claim 1 in which said one pulley is crowned, and which further comprises means for acting on opposite sides of said abrasive belt to cause it to conform to the crowned shape of said one pulley.

14. A copying machine tool according to claim 1 which further comprises resilient means biasing said material-removing means towards said workpiece, and stop means for limiting movement of said material-removing means relative to said second mounting towards said workpiece.

* * * * *